United States Patent [19]

Tanaka et al.

[11] Patent Number: 5,038,890

[45] Date of Patent: Aug. 13, 1991

[54] OIL PAN STRUCTURE FOR INTERNAL COMBUSTION ENGINE

[75] Inventors: Shuji Tanaka; Toshihiro Hirai, both of Yokohama, Japan

[73] Assignee: Nissan Motor Co., Ltd., Yokohama, Japan

[21] Appl. No.: 505,280

[22] Filed: Apr. 6, 1990

[30] Foreign Application Priority Data

Apr. 14, 1989 [JP] Japan ..... 1-43955[U]

[51] Int. Cl.[5] ..... F01M 1/04

[52] U.S. Cl. ..... 184/6.5; 184/106; 123/196 R

[58] Field of Search ..... 184/6.5, 106, 1.5; 123/196 R, 195 C, 198 E

[56] References Cited

U.S. PATENT DOCUMENTS

| | | | |
|---|---|---|---|
| 1,713,872 | 5/1929 | Hunt | 184/6.5 |
| 2,408,923 | 10/1946 | Frederick | 184/106 |
| 2,577,188 | 12/1951 | Hall | 184/106 |
| 3,688,871 | 8/1972 | Krestan et al. | 184/6.5 |
| 3,888,227 | 6/1975 | Green et al. | 184/6.5 |
| 4,848,293 | 7/1989 | Sasada et al. | 123/195 C |

FOREIGN PATENT DOCUMENTS

| | | | |
|---|---|---|---|
| 2751982 | 5/1979 | Fed. Rep. of Germany | 123/195 C |
| 1095948 | 12/1967 | United Kingdom . | |
| 1255320 | 12/1971 | United Kingdom . | |

*Primary Examiner*—James C. Yeung
*Assistant Examiner*—Alan Cariaso
*Attorney, Agent, or Firm*—Foley & Lardner

[57] ABSTRACT

An oil pan for an internal combustion engine having an engine lubrication system. The oil pan comprises a shallow bottom section and a sump section. An oil return path is formed at a side of the bottom surface of the shallow bottom section to which a major part of lubrication oil in the shallow bottom section is guided under the force caused by the rotation of the crankshaft. The oil return path is formed by the generally tube-shaped members. The oil return path has an inlet opened opposite to the crankshaft and an outlet opened opposite to the bottom of the sump section. Therefore, the lubrication oil in the shallow bottom section is effectively guided to the inlet of the oil return path and returned into the sump section under the force caused by the rotation of the crankshaft or the like.

14 Claims, 7 Drawing Sheets

OIL PAN STRUCTURE FOR INTERNAL COMBUSTION ENGINE

BACKGROUND OF THE INVENTION

1. Field of the Invention

This invention relates to improvements in an oil pan for an automotive vehicle, and more particularly to the oil pan with which splashed oil is effectively returned into a sump section.

2. Description of the Prior Art

It is well known that an internal combustion engine is provided with an oil pan with which lubrication oil dropped in the oil pan is collected in a sump of the oil pan to be fed to various sections of the engine by an oil pump. In order to effectively return the lubrication oil into the sump, it has been proposed that an oil pan has a plurality of guide ribs on a shallow bottom section of the oil pan as shown in the FIG. 7 of the present application. Such an arrangement is disclosed, for example, in Japanese Patent Publication 53-16048.

As shown in FIG. 7, an oil pan 51 includes a sump 52 which is disposed under a cylinder block and along the axis of a crankshaft. A shallow bottom section 53 is disposed under the cylinder block and defines a space which is communicated with the sump section 52. An oil strainer (not shown) is disposed in the sump section 52. A generally straight rib 54 is formed at the upper surface on one side of the shallow bottom section 53 which side is located downstream of the oil flow caused by the rotation of the crankshaft. The straight rib 54 extends generally in the longitudinal direction of the engine. A plurality of arcuate ribs 55 are formed at the upper surface on the side of the shallow bottom section 53. Lubrication oil in the shallow bottom section 53 is forced in the direction indicated by arrows A under the rotation of the crankshaft. This causes lubrication oil to be rapidly returned from the shallow bottom section 52 into the sump section 52. The shallow bottom section 53 is located considerably near the crankshaft since modern engines have become formed smaller.

However, with this conventional arrangement, lubrication oil guided by the ribs 55 flows into the sump section 52 through a flat section 56 which is formed between the rib 54 and the end 55*a* of the each rib 55. Therefore, the oil tends to be splashed by the crankshaft and connecting rods. This causes the problems that the oil amount lacks in the sump section 52, and therefore air is sucked into an oil flowing circuits through the oil strainer. Thus, a large amount of air bubble is mixed with the oil.

SUMMARY OF THE INVENTION

It is an object of the present invention to provide an oil pan for an internal combustion engine with which lubrication oil in a shallow bottom section is returned in a sump section.

An oil pan for an internal combustion engine comprising a shallow bottom section fixedly disposed under a cylinder block of the engine. The shallow bottom section having a bottom surface thereon. The bottom surface defines thereover a space in which a crankshaft is disposed. A sump section defines a sump and is located under the cylinder block. The sump is communicated with the shallow bottom section space. The sump has a lower part which is lower in level than the bottom surface. An oil return path is formed in the shallow bottom section and is located on a side which is located downstream of the oil flow caused by rotation of the crankshaft. The oil return path defined by the generally tube-shaped surfaces. The oil return path is located generally parallel with the axis of the crankshaft. The oil return path has an inlet which is opened opposite to the oil flow and has an outlet which is communicated with the sump.

With the thus arranged oil pan, since the flow of lubrication oil caused by the crankshaft under rotation can be used for returning the oil, the oil in the shallow bottom section can be rapidly returned into the sump section through the guide rib and the oil return path in the shallow bottom section Therefore, a sufficient amount of lubrication oil is always stored in the sump, thereby suppressing the mixing of the air into the oil.

DETAILED DESCRIPTION OF THE INVENTION

Figure 1:
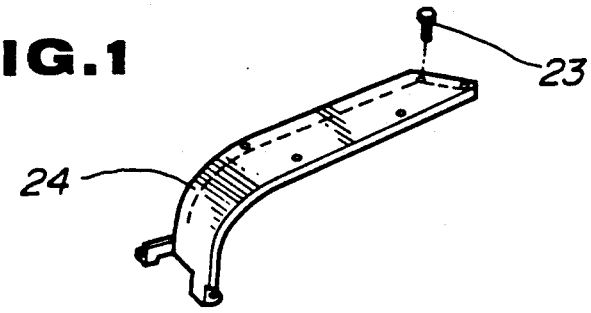
FIG. 1 is an exploded perspective view of an embodiment of an oil pan according to the present invention.
Figure 1:
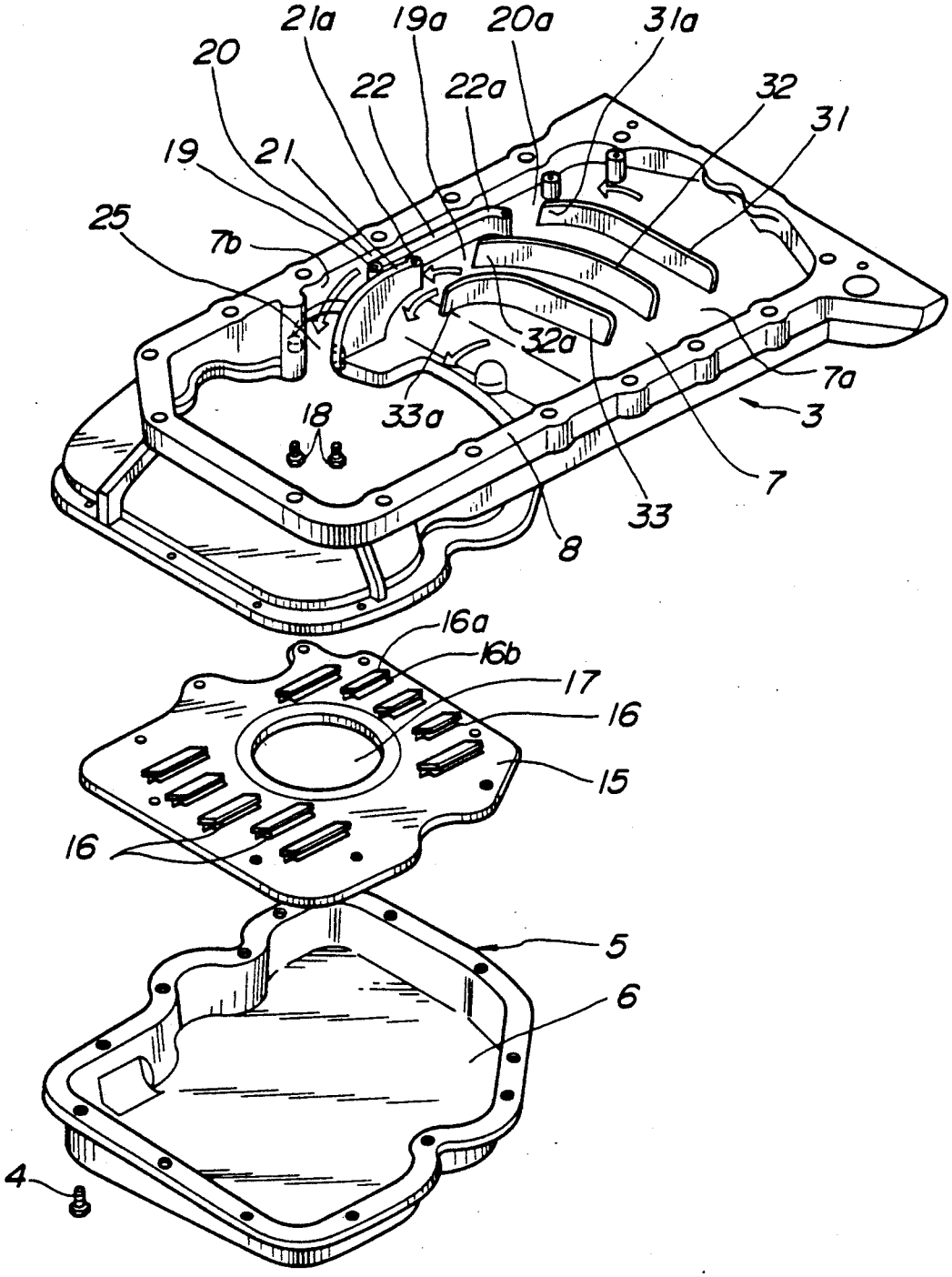

Referring now to FIGS. 1 to 4, an embodiment of an oil pan for a four-cylinder engine 1, according to the present invention is illustrated by the reference numeral 2.

Figure 3:
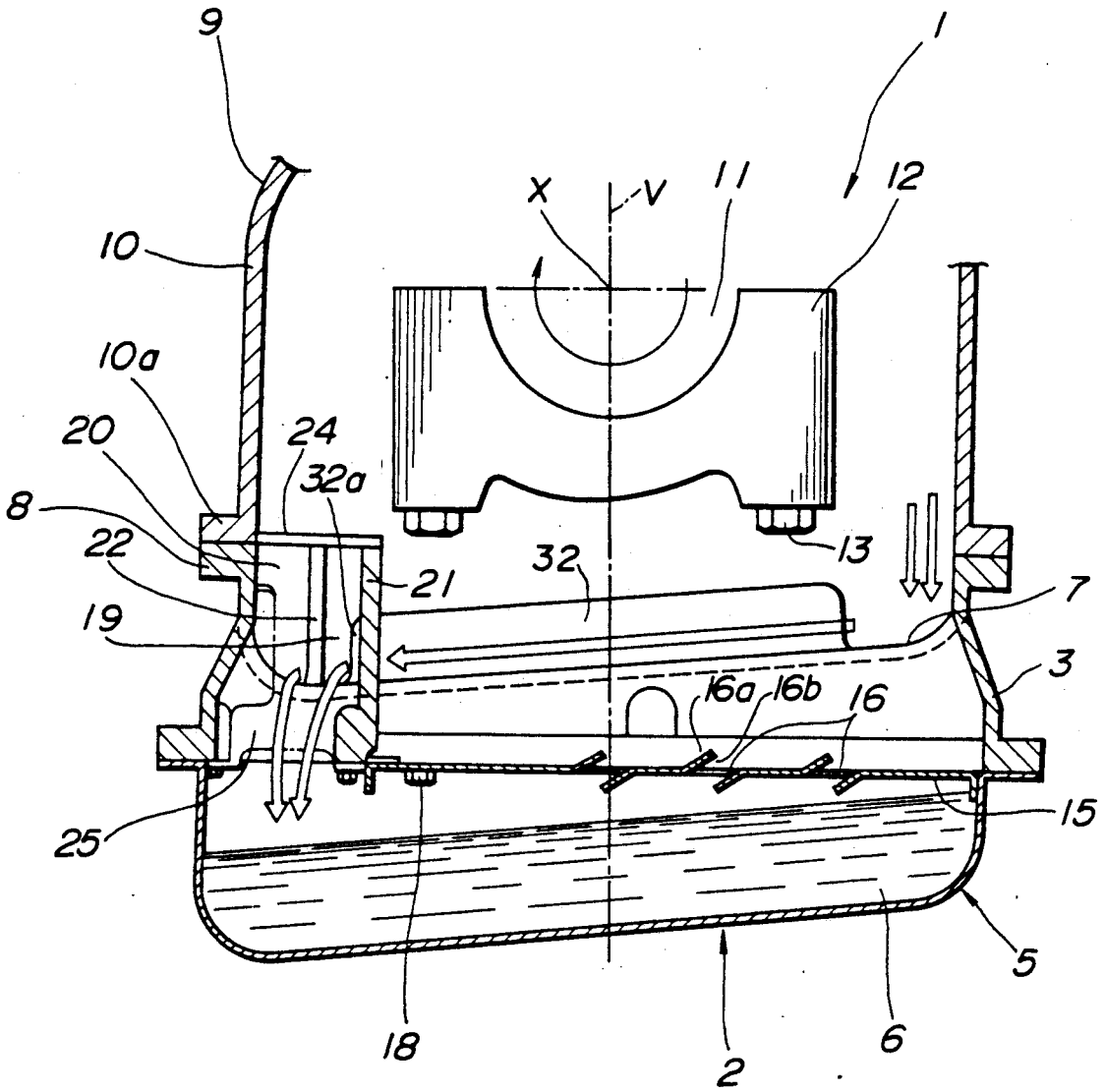
FIG. 3 is a vertical cross-sectional view of the oil pan along a plane perpendicular to the axis of a crankshaft, showing an installation condition of the oil pan.
Figure 4:
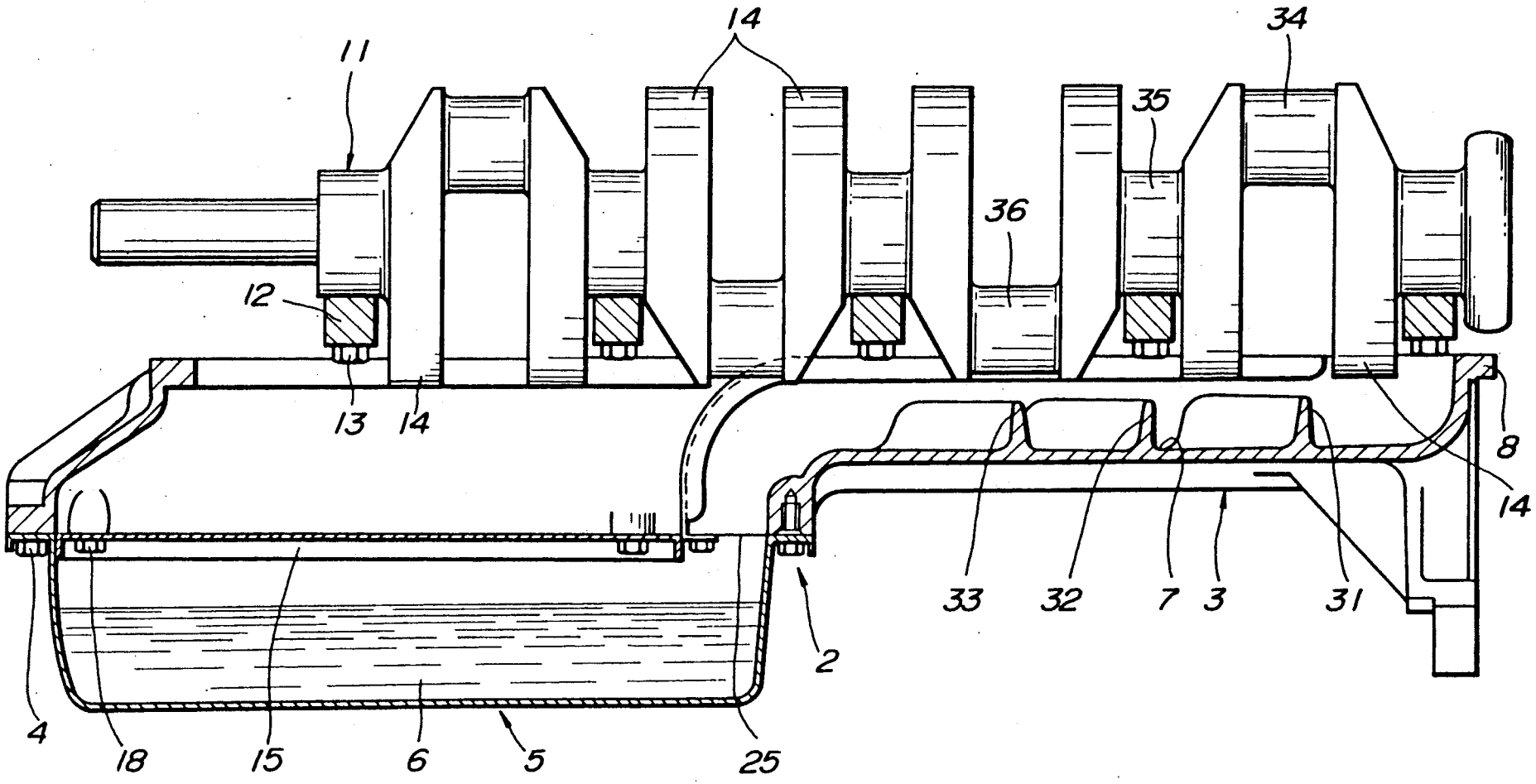
FIG. 4 is a vertical cross-section view of the oil pan of FIG. 1 along a plane parallel with the axis of the crankshaft.

The oil pan 2 comprises an upper oil pan 3 which is made of aluminum alloy casting. A front lower surface 3*a* of the upper oil pan 3 is fixedly connected to a lower oil pan 5 made of sheet metal with bolts 4. The lower oil pan 5 defines a sump 6 in which lubrication oil is stored. The upper oil pan 3 has a shallow bottom section 7 defining a space. The shallow bottom section 7 is constituted by a bottom s surface 7*a* and a side wall 7*b*. Lubrication oil flows into the shallow bottom section 7 and into the sump 6 after the lubrication of various parts in the engine 1. An endless or continuous flange section 8 is formed integral with the upper oil pan 3 at the upper surface. The flange section 8 is fixedly connected to an oil pan installation rail 10*a* which is disposed under the lower end of a skirt section 10 of a cylinder block 9. As shown in FIGS. 3 and 4, a crankshaft 11 of the engine 1 is rotatably supported by bearing caps 12 which are fixed to the cylinder block 9 with bearing cap bolts 13. Thus, the shallow bottom section 7 is located relatively near a crankshaft rotation system, including counterweights 14, the big end of connecting rods (not shown) and the like. A rotational axis of the crankshaft rotation system is indicated by the character X in FIG. 3. There is shown an imaginary vertical plane V including the rotational axis X in FIGS. 2 and 3. The vertical plane V imaginary divides the engine 1 into first and second sections. The first section is located on the upstream side of the oil flow on the surface of the shallow bottom section 7 and caused by the crankshaft 11 under rotation. The second section is located on the downstream side of the oil flow caused by the crankshaft 11 under rotation.

A baffle plate 15 for suppressing the shake of the oil level is fitted to the upper part of the lower oil pan 5 to cover the sump 6. The baffle plate 15 has a plurality of louvers 16 which include louver fins 16*a* and are formed with openings 16*b* through which the sump is communicated with the space defined by the shallow bottom section 7. The louver fins 16*a* are formed inclined upwardly opposite to the oil flow caused by the crankshaft 11 under rotation, so that the oil is effectively guided into the sump 6. The baffle plate 15 has an opening 17 at its central part so that an oil strainer 26 can pass through the opening 17 into the sump 6. The baffle plate 15 is secured to the lower surface of the upper oil pan 3 with bolts 18. First and second oil return paths 19, 20 are formed on the second side of the shallow bottom section 7. The first oil return path 19 is disposed nearer to the vertical plane V than the second oil return path 20. Each oil return path 19, 20 is located generally parallel with the vertical plane V. First and second partition walls 21, 22 are formed on the second section of the shallow bottom section 7 to be generally parallel with the vertical plane V. The partition walls 21, 22 are formed integrally with the shallow bottom section 7 by casting. The first partition wall 21 is disposed nearer to the vertical plane V than the second partition wall 22.

A cover member 24 is secured to the partition walls 21, 22 with bolts 23 to define the upper part of the oil return paths 19, 20. The cover member 24 is located opposite to the bottom surface 7*a* of the shallow bottom section 7. Therefore, the first oil return path 19 is defined by the bottom surface 7*a* of the shallow bottom section 7, the lower surface of the cover member 24, the first and second partition walls 21, 22. The second oil return path is defined by the bottom surface 7*a* of the shallow bottom section 7, the under surface of the cover member 24, the second partition wall 22 and the side wall 7*b* of the second section of the shallow bottom section 7. Such members defining the first and second oil return paths 19, 20 are assembled in a generally tube-shape. The first partition wall 21 is located nearer to the sump 6 than the second partition wall 22, so that an inlet 19*a* of the first oil return path 19 is opened opposite to the vertical plane V. Therefore, the first inlet 19*a* can effectively receive lubrication oil splashed by the crankshaft 11 under rotation. An end 22*a* of the second partition wall 22 is formed bent toward the vertical plane V. Accordingly, an inlet 20*a* of the second oil return path 20 is also opened opposite to the vertical plane V. The other ends of the oil return paths 19, 20 are combined with each other and form an outlet 25. The outlet 25 is downwardly opened toward the sump 6 and connected to the sump 6. The cover member 24 is smoothly curved along the top of the partition walls 21, 22, so that the end of the sump side of the cover member 24 extends toward the bottom of the sump 6.

First, second and third guide ribs 31, 32, 33 upwardly extend from the bottom surface of the shallow bottom section 7 and extend generally perpendicular to the axis of the crankshaft 11. The guide ribs 31, 32, 33 are aligned from the far side against the sump 6 in the order of the first, second and third guide ribs 31, 32, 33. The guide ribs 31, 32, 33 are integrally formed with the upper oil pan 3 by casting. As shown in FIG. 4, the first guide rib 31 is located under a No. 4 crank pin 34, the second guide rib 32 under a No. 4 main journal 35, the third guide rib 33 under a No. 3 crank pin 36. Accordingly, each counterweight 14 is located above each space defined by the adjacent guide ribs (31, 32; 32, 33) so that the blown air pressure caused by the rotation of the crankshaft 11 is effectively applied to the lubrication oil on the shallow bottom section 7.

Figure 2:
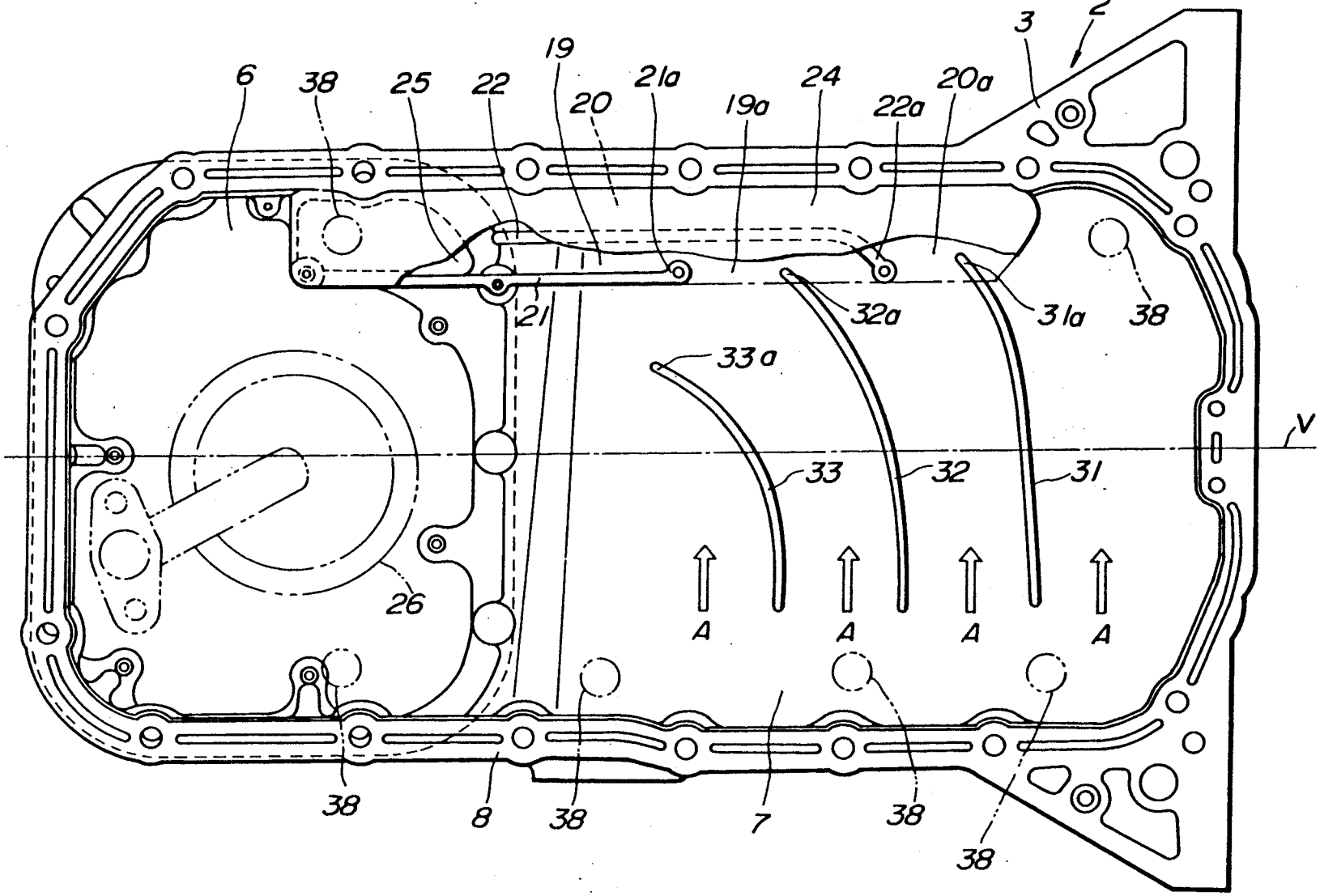
FIG. 2 is a plan view, partly in section, of the oil pan of FIG. 1.

As shown in FIG. 2 in detail, the first guide rib 31 is gradually sharply curved from the first side of the shallow bottom section 7 toward the sump 6 so as to gradually approach to the sump 6. An end 31*a* of the first guide rib 31 extends slightly into the inlet 20*a* of the second oil return path 20. The end 31*a* is located farther to the sump 6 than the end 22*a* of the second partition wall 22. Thus, a predetermined distance or space is formed between the first guide rib end 31*a* and the second partition wall end 22*a*. Similarly, the second guide rib 32 is gradually sharply curved from the first side of the shallow bottom section 7 toward the sump 6 to approach to the sump 6. An end 32*a* of the second guide rib 32 extends slightly into the inlet 19*a* of the first oil return path 19. The end 32*a* is located farther to the sump 6 than an end 21*a* of the first partition wall 21. Thus, a predetermined distance or space is formed between the second guide rib end 32*a* and the first partition wall end 21*a*. The third guide rib 33 is more sharply curved as compared with the first and second guide ribs 31, 32 so that an end 33*a* of the third guide rib 33 is directed to the sump 6. The other ends (no numeral) of the guide ribs 31, 32, 33 are located on the generally middle part between the vertical plane V and the side wall of the first section of the shallow bottom section 7.

In FIG. 2, the positions of oil paths 38 formed in the cylinder block 9 are illustrated by small circles described by dot-dot-dash lines. Lubrication oil which has lubricated an engine valves system or the like in the cylinder head (not shown) is returned into the crankcase through the oil paths 38 and is dropped into the oil pan 2.

With the thus arranged oil pan 2, when the crankshaft 11 is rotated clockwise as shown in FIG. 3, the counterweights 14 and the like under rotation makes a blown air pressure and directly strike against the lubrication oil to cause the flow of the lubrication oil on the bottom surface 7*a* in the shallow bottom section 7. Therefore, the lubrication oil receives the force which is directed in the direction along arrows A of the FIG. 2. The lubrication oil in the shallow bottom section 7 flows along the guide ribs 31, 32, 33, so that the major part of the lubrication oil in the shallow bottom section 7 is guided into the oil return paths 19, 20. Since the flowing oil along the guide ribs 31, 32, 33 is directed toward the sump 6, the major part of the oil smoothly flows into the sump 6 through the oil return paths 19, 20. Additionally, the other part of the oil is directly returned into the sump 6.

With this arrangement, since the major part of the lubrication oil in the shallow bottom section is rapidly guided into the oil return paths 19, 20 by the guide ribs 31, 32 ,33 and is smoothly returned into the sump 6 through the oil return paths 19, 20, the oil splashing caused by the crankshaft 11 under rotation is largely reduced. Therefore, a sufficient amount of lubrication oil is stored in the sump 6. Additionally, in case that the oil is carried into the shallow bottom section 7 by the inclination or the like of the vehicle, since lubrication oil directly splashed by the counterweights 13 or the like is guided to the oil return paths 19, 20 and to the sump 6, the oil is rapidly returned into the sump 6. Furthermore, in case that a lot of lubrication oil is dropped in the shallow bottom section 7, for example, under the high speed rotation of the engine, if the dropped oil amount in the shallow bottom section 7 exceeds a value at which lubrication oil can be returned to the sump 6 through the oil return paths 19, 20, the oil which cannot flow into the oil return paths 19, 20 can be returned into the sump 6 through the spaces formed between the second guide rib end 32*a* and the first partition wall end 21*a*, and between the first guide rib end 31*a* and the second partition wall end 22*a*. Therefore, lubrication oil can be always smoothly returned into the sump 6 without overflowing the guide ribs 31, 32, 33.

Figure 5:
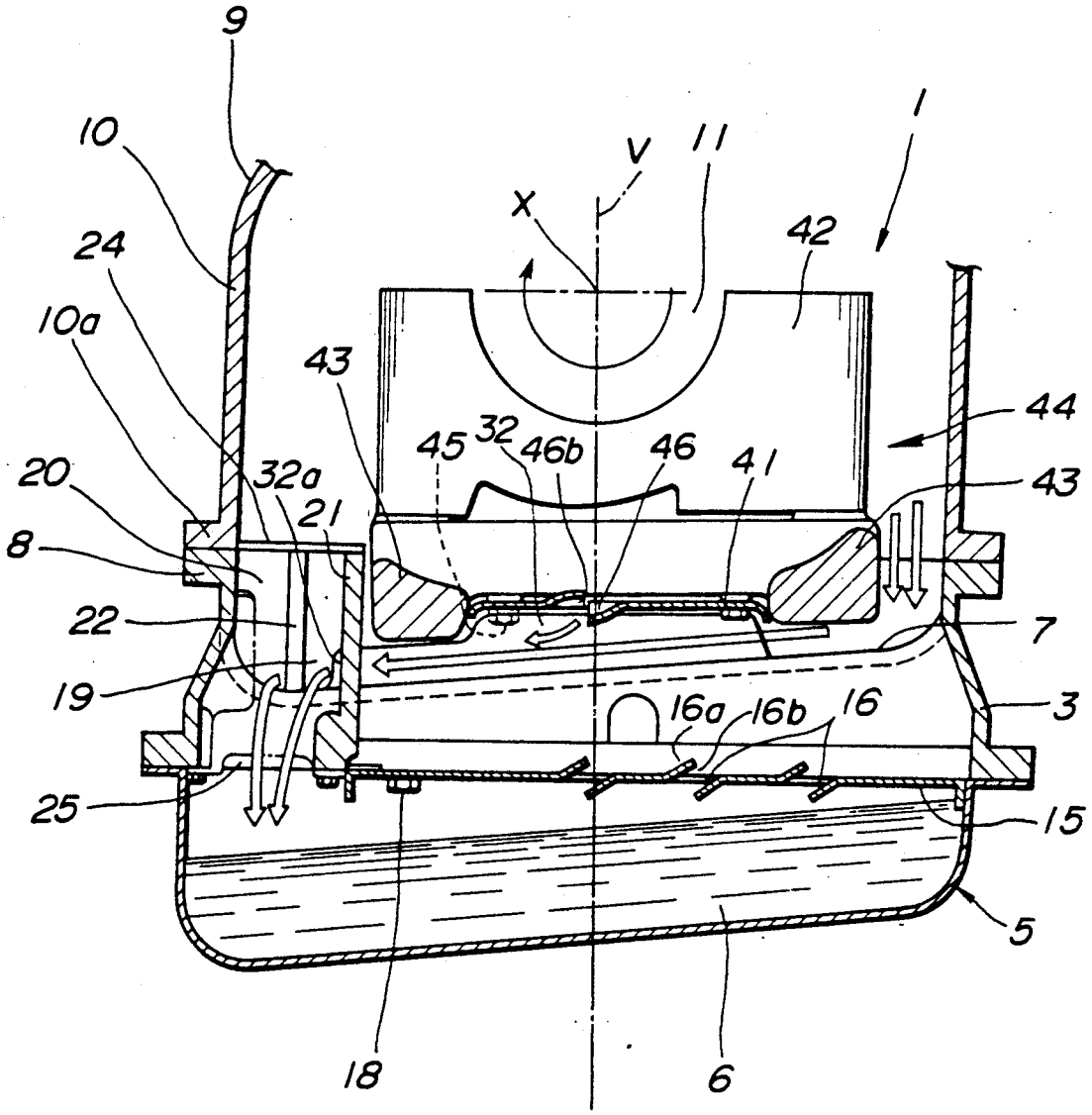
FIG. 5 is a vertical cross-sectional view of an anther embodiment of an oil pan according to the present invention along a plane perpendicular to the axis of a crankshaft, showing an installation condition of the oil pan to an engine.
Figure 6:
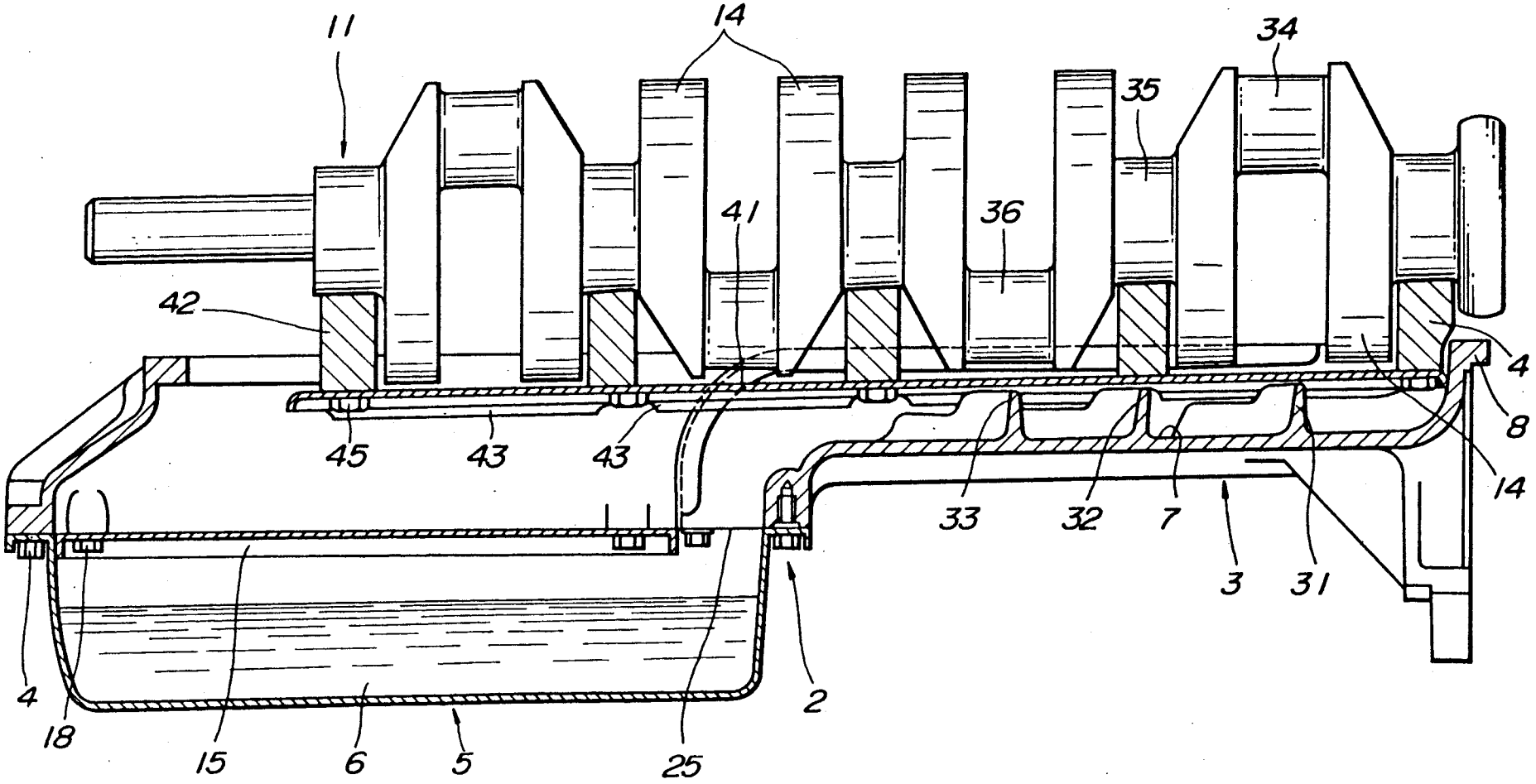
FIG. 6 is a vertical cross-section view of the oil pan of FIG. 5 along a plane parallel with the axis of the crankshaft.
Figure 7:
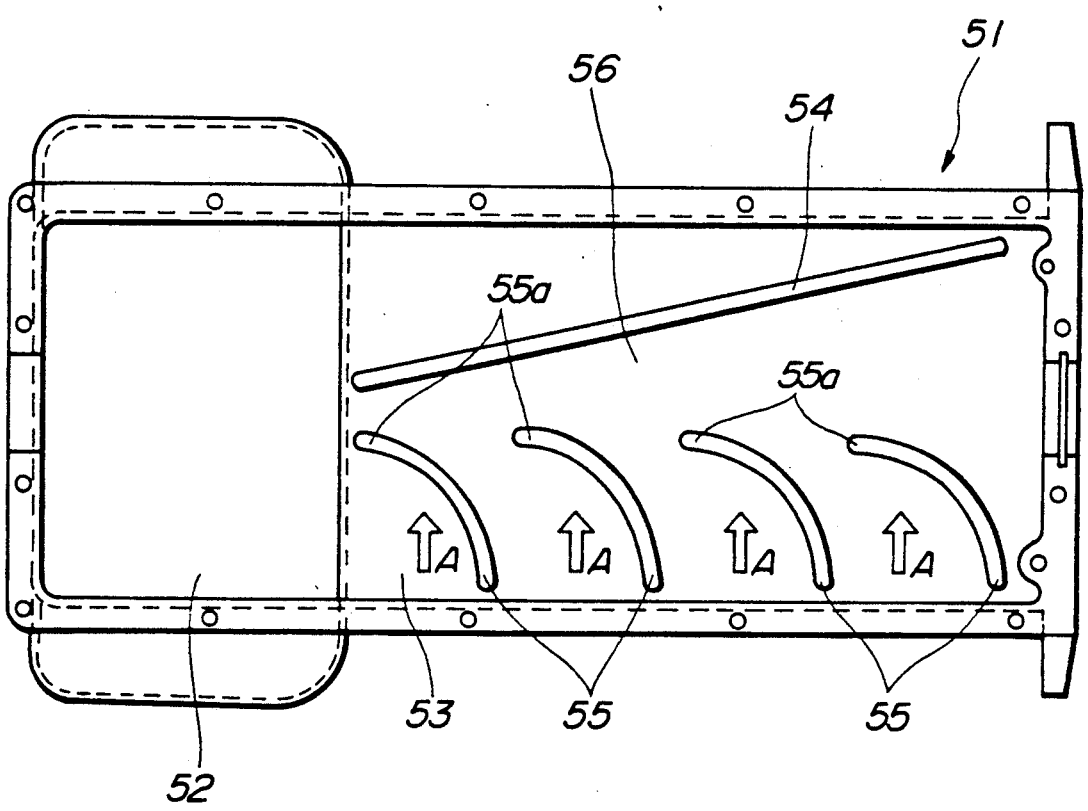
FIG. 7 (PRIOR ART)
FIG. 7 is a plan view of a conventional oil pan.

FIGS. 5 and 6 illustrate another embodiment of the oil pan according to the present invention. In this embodiment, the guide ribs 31, 32, 33 and the oil return paths 19, 20 are essentially similar to those of the first embodiment. A taffle plate 41 is disposed under the crankshaft 11 and above the guide ribs 31, 32, 33 to cover the major part of the crankshaft 11, so that the splashing of the lubrication oil in the shallow bottom section 7 is suppressed.

The crankshaft 11 is rotatably supported by the cylinder block 9 and bearing caps 12 at five sections through bearings (not shown). The bearing caps 42 are fixedly secured to the under surface of the cylinder block 9. A pair of beams 43 of a bearing beam 44 extend generally parallely with the axis of the crankshaft 11 and are fixedly connected under the bearing caps 42. The baffle plate 41 is generally horizontally secured to the under surface of the bearing beam 44 with bolts 45 to cover the crankshaft 11. The baffle plate 41 has a plurality of louvers 46 which are formed inclined upwardly toward the first side. A slight clearance is formed between the baffle plate 41 and the top edge of the each guide rib 31, 32, 33. Therefore, the blown air pressure caused by the crankshaft 11 under rotation is guided to the space formed between the baffle plate 41 and the shallow bottom section 7 through the opening of the louvers 46.

With the thus arranged oil pan system, since the crankshaft 11 is covered with the baffle plate 41 to separate the lubrication oil in the shallow bottom section 7 from the crankshaft 11, the splashing of the lubrication oil is largely reduced. Although the baffle plate 41 is horizontally disposed above the center part of the shallow bottom section 7 and along the axial direction of the crankshaft 11, the blown air pressure caused by the crankshaft 11 under rotation can be guided into the shallow bottom section 7 through openings 46*b* formed between the louvers 46 and a space formed between the inner surface of the skirt section 10 of the first section and the first side one of the beams 43. Therefore, the lubrication oil gets the force caused by the blown air pressure, thereby enabling to be smoothly returned into the sump 6 through the guide rib 31, 32, 33.

What is claimed is:

1. An oil pan for an internal combustion engine having a crankshaft, comprising:

a shallow bottom section fixedly disposed under a cylinder block of the engine, said shallow bottom section having a bottom surface, said bottom surface defining thereover a space in which the crankshaft is disposed, said bottom surface being formed to allow oil to flow in a direction generally perpendicular to a vertical plane which passes through an axis of rotation of the crankshaft;

a sump section defining a sump, located under said cylinder block, said sump being in communication with said shallow bottom section space, said sump having a lower part which is lower in level than said bottom surface;

means for causing oil flow on said bottom surface of said shallow bottom section, said means for causing oil flow being in a direction generally perpendicular to said vertical plane, and including a means for directly applying kinetic energy to the oil on said bottom surface, wherein said kinetic energy is created by a rotation of said crankshaft; and means for defining an oil return path at least a part of which is formed in said shallow bottom section and which is located on a side of the shallow bottom section located downstream of the oil flow produced by said means for causing oil flow, said oil return path being located generally parallel with the axis of rotation of the crankshaft, said oil return path having an inlet which is opened opposite to the oil flow and having an outlet which is in communication with said sump.

2. An oil pan as claimed in claim 1, wherein said shallow bottom section includes first and second sections which are imaginary divided by an imaginary vertical plane containing the crankshaft axis, at least a part of said oil return path being formed in said second section positioned on said side, said oil flow on said shallow bottom section bottom surface being caused in a direction from said first section to said second section under rotation of the crankshaft.

3. An oil pan as claimed in claim 1, further comprising a plurality of guide ribs which extend generally perpendicular to axis of the crankshaft, each of said guide ribs curving toward said sump section, an end of said guide rib extending toward said oil return path inlet.

4. An oil pan as claimed in claim 1, wherein said oil return path defining means includes a partition wall formed on the bottom surface and extending generally parallel with said vertical plane, a side wall of said shallow bottom section, a part of the bottom surface of said shallow bottom section, and a cover member which is installed on the partition wall to be opposite to the bottom surface of said shallow bottom section.

5. An oil pan as claimed in claim 4, wherein said cover member is secured on said partition wall with bolts.

6. An oil pan as claimed in claim 1, further comprising a first baffle plate formed with louvers through which a part of lubrication oil flows into said sump.

7. An oil pan as claimed in claim 1, wherein said oil pan is constituted by an upper oil pan and a lower oil pan, a part of the upper oil pan forms said shallow bottom section, the lower oil pan forms said sump section.

8. An oil pan as claimed in claim 6, wherein said the upper oil pan is made of aluminum alloy casting, and the lower oil pan is made of sheet metal.

9. An oil pan as claimed in claim 1, wherein said partition wall includes first and second partition walls, said first partition wall being located nearer to said vertical plane than said second partition wall.

10. An oil pan as claimed in claim 1, further comprising a second baffle plate disposed under the crankshaft and above said guide ribs to cover major part of the crankshaft so that splashing of lubrication oil in said shallow bottom section is suppressed.

11. An oil pan as claimed in claim 2, wherein said guide ribs are formed integral with said shallow bottom section.

12. An oil pan as claimed in claim 2, wherein said guide ribs define therebetween a space which is located under one of counterweights of the crankshaft.

13. An oil pan as claimed in claim 3, wherein said partition wall is formed integral with said shallow bottom section.

14. An oil pan as claimed in claim 1, wherein said oil return path is formed in a tube-shape.

* * * * *